US005495320A

United States Patent [19]

Araki et al.

[11] Patent Number: 5,495,320

[45] Date of Patent: Feb. 27, 1996

[54] DEVELOPER STIRRING DEVICE AND DEVELOPING DEVICE AND IMAGE FORMING APPARATUS USING THE SAME

[75] Inventors: Takamasa Araki; Jun Shimizu; Kazuyoshi Sakazawa, all of Kato, Japan

[73] Assignee: Fujitsu Limited, Kawasaki, Japan

[21] Appl. No.: 277,516

[22] Filed: Jul. 19, 1994

[30] Foreign Application Priority Data

Nov. 30, 1993 [JP] Japan ..... 5-299977

[51] Int. Cl.[6] ..... G03G 15/08

[52] U.S. Cl. ..... 355/245; 118/653

[58] Field of Search ..... 355/245, 253, 355/260; 118/653, 657; 366/291

[56] References Cited

U.S. PATENT DOCUMENTS 3,943,886 3/1976 Vola et al. ..... 118/657

5,142,333 8/1992 Verbeek et al. .

FOREIGN PATENT DOCUMENTS 63-127273 5/1988 Japan .
3-260678 11/1991 Japan .
3-282489 12/1991 Japan .
3-274072 12/1991 Japan .
5-72891 3/1993 Japan .
5-88543 4/1993 Japan .
5-249828 9/1993 Japan .

*Primary Examiner*—Joan H. Pendegrass
*Attorney, Agent, or Firm*—Nikaido, Marmelstein, Murray & Oram

[57] ABSTRACT

A developer stirring device including stirring paths parallel to each other and stirring screws respectively disposed in the stirring paths, in which a delivering element for a developer is provided on one of the stirring screws and a distributing element is provided on the other of the stirring screws so as to allow the developer to circulate through the stirring paths without stagnation, and a developing device for an image forming apparatus using the same.

28 Claims, 10 Drawing Sheets

DEVELOPER STIRRING DEVICE AND DEVELOPING DEVICE AND IMAGE FORMING APPARATUS USING THE SAME

BACKGROUND OF THE INVENTION

1. Field of the Invention

The present invention relates to an image forming apparatus such as a copying machine and a printer, as well as a developing device and a developer stirring device to be used therein.

2. Description of Related Art

In an image forming apparatus such as a copying machine and a printer, an image is formed through the following processes: an exposing process for forming a desired electrostatic latent image on the surface of a photosensitive drum; a developing process for developing the electrostatic latent image by adhering toner onto the electrostatic latent image; a transferring process for transferring the developed toner image onto desired transfer paper; and a fixing process for fixing the transferred toner image on the paper by heat. The exposing, developing and transferring processes are successively performed by respective devices provided around the photosensitive drum in accordance with the rotation of the photosensitive drum.

Among these devices, a developing device is disposed in the vicinity of the photosensitive drum, and includes a developing roller rotating around an axis parallel to the photosensitive drum, a toner supplier for supplying toner for development to the developing roller and a developer stirring device provided therebetween. The developing roller is a magnetic roller comprising a non-magnetic outer cylinder and a plurality of fixed magnets circumferentially disposed on the inner surface of the outer cylinder. The developer stirring device disposed along the developing roller mixes toner supplied by the toner supplier with a carrier made of magnetic powder to obtain a developer, in which the toner is held on the surfaces of the particles of the carrier.

in such a developing device, the toner and the carrier in the developer are attracted to the outer cylinder of the developing roller by the magnetic force of the fixed magnets, kept adsorbed by the magnetic field circumferentially formed by the fixed magnets, and conveyed in the circumferential direction as the outer cylinder rotates. The toner is thus fed to a position opposing the photosensitive drum, and attracted to the electrostatic latent image formed on the surface of the photosensitive drum by the electrostatic force, thereby separating from the carrier to move onto the photosensitive drum. In this manner, the toner image is formed. The carrier remained on the developing roller is dropped from the outer cylinder during the further rotation and sent back to the developer stirring device for reuse.

In order to attain an excellent development quality in the developing procedure performed in the above-mentioned manner, the developer supplied to each position along the developing roller is required to have a toner concentration as uniform as possible. To meet this demand, a conventionally used developer stirring device includes a pair of stirring paths disposed parallel between the developing roller and the toner supplier. In each of the stirring paths, a stirring screw is provided to convey and stir the developer by the rotation thereof.

The stirring paths are communicated with each other through communicating ports at both the lengthwise ends thereof, and the stirring screws therein are driven to rotate so as to convey the developer in the opposite directions to each other. The toner supplied from the toner supplier to the stirring path along the toner supplier is stirred by the rotation of the stirring screw therein, conveyed while being uniformly mixed with the carrier, and fed to the other stirring path along the developing roller through the communicating ports at one end of the stirring paths. The toner mixed with the carrier, that is, the developer is further stirred and conveyed by the rotation of the stirring screw in the stirring path along the developing roller and goes back to the stirring path along the toner supplier through the communicating ports at the other end of the stirring paths. Then, fresh toner is supplied to the stirring path along the toner supplier, and this cycle is repeated thereafter.

In such a developer stirring device, the developer having a certain toner concentration is fed to the stirring path along the developing roller after being stirred and conveyed through the stirring path along the toner supplier. Such a developer with a uniform toner concentration is distributed over the entire length of throughout the developing roller. Thus, the above-mentioned demand is met, resulting in an excellent development quality.

Larger-scale image forming apparatus, however, are Fabricated these years, and therefore, the length of the developing roller corresponding to the size of the photosensitive drum also becomes larger. When the above described developer stirring device is used in such a large image forming apparatus, the toner concentration in the developer is lowered during the conveyance through the stirring path along the long developing roller. As a result, it is disadvantageously difficult to make uniform the toner concentration at each point throughout the developing roller.

In order to solve this problem, Japanese Patent Application Laid-open Nos. 3-260678 (1991) and 3-274072 (1991) disclose a developer stirring device in which a pair of stirring paths respectively disposed along the toner supplier and the developing roller are communicated with each other not only at the lengthwise ends of the stirring paths but also at the center thereof. In one of the stirring paths, the developer is conveyed from the lengthwise ends toward the center by the rotation of the stirring screw in the stirring path. In the other stirring path, the developer is conveyed from tile center toward the ends thereof.

FIG. 1 shows the operation of such a developer stirring device. As is shown in FIG. 1, the developer stirring device has such a structure that stirring paths 1 and 2 disposed parallel to each other respectively include stirring screws 3 and 4. The stirring paths 1 and 2 are provided between and along a developing roller 5 and a toner supplier 6, and communicated with each other through communicating ports A at both the lengthwise ends and a communicating port B at the center. The stirring screws 3 and 4 have, on the right and left sides of the middle communicating port B, stirring plates 30, 30 and 40, 40, respectively, and the right side plate and the left side plate are spiral in the opposite directions to each other. The stirring screw 3 along the developing roller 5 is driven to rotate around an axis 31 so as to set the conveying direction of the stirring plates 30, 30 toward the center communicating port B, and the stirring screw 4 along the toner supplier 6 is driven to rotate around an axis 41 so as to set the conveying direction of the stirring plates 40, 40 away from the center communicating port B.

In the developer stirring device having the above-mentioned structure, toner is supplied by the toner supplier 6 to the center of the stirring path 2. The supplied toner is stirred and conveyed toward the lengthwise ends by the rotation of the stirring screw 4, during which the toner is mixed with a carrier to obtain a developer. The developer having reached both the ends of the stirring path 2 is fed to the stirring path 1 through the communicating ports A, and then, stirred and conveyed toward the center of the stirring path 1 by the rotation of the stirring screw 3, during which the toner in the developer is attracted by the developing roller 5 to be used in the developing procedure. The developer collected in the middle of the stirring path 1 by the rotation of the stirring screw 3 goes back to the stirring path 2 through the center communicating port B, supplied with fresh toner in the stirring path 2, and conveyed toward both the ends again.

In this manner, the developer in the stirring paths 1 and 2 is circulated as shown with arrows in FIG. 1 through the communicating port B between the stirring paths every time the developer passes through the right or left half of one of the stirring paths. Therefore, the developer is attracted by the developing roller 5 while it is in the left or right half of the stirring path 1. As a result, the loner concentration in the developer little can be stable over the entire length of the developing roller 5, thereby improving the development quality.

Further, the developer stirring device disclosed in Japanese Patent Application Laid-open Nos. 3-260678 (1991) and 3-274072 (1991) has distributing means facing the communicating port B in the stirring path 2, thereby distributing the developer fed from the stirring path 1 through the communicating port B to the right and left portions of the stirring path 2. Thus, the developer passed through the right and left portions is interchanged to prevent difference in the toner concentration in the developer circulating through the right and left portions of the stirring paths.

In addition, in the developer stirring device disclosed in Japanese Laid-open Patent Publication No. 3-260678(1991), an inclined plate is coaxially provided to the stirring screw 4. This inclined plate rotates together with the stirring screw 4, thereby varying the extent of the distribution of the developer to the right and left portions of the stirring path. The developer stirring device disclosed in Japanese Patent Application Laid-open No. 3-274072 (1991) has a regulating member longitudinally reciprocating in accordance with the rotation of the stirring screw 4. Thus, the feeding of the developer to the right and left portions is successively regulated.

Nevertheless, also in the developer stirring device described in the aforementioned publications, after being collected in the middle of the stirring path 1 by the rotation of the stirring screw 3, the developer stops in the vicinity of the communicating port B for a while. When a certain amount of the developer is retained, it is fed to the stirring path 2 at one time. Thus, the developer is irregularly fed to the stirring path 2, resulting in varying the amount of the developer going back to the stirring path 2. Therefore, even when the above-mentioned distributing means works properly, the amount of the developer distributed to the right and left port, ions varies. As a result, the toner concentration in the developer circulating through these portions differs from each other. In a developing device and an image forming apparatus using such a developer stirring device, therefore, it is disadvantageously difficult to attain a desired development quality due to such a difference in the toner concentration.

SUMMARY OF THE INVENTION

This invention is attained in order to solve the above-mentioned problems, and the objective thereof is providing a developer stirring device comprising delivering means for a developer on one of stirring screws disposed along a developing roller and a toner supplier and distributing means on the other of the stirring screws so as to allow the developer to circulate through stirring paths without stagnation and to make the toner concentration at each point throughout the developing roller as uniform as possible; as well as providing a developing device and an image forming apparatus which provide a high and stable development quality by using the developer stirring device.

In order to attain the aforementioned objective, the developer stirring device of this invention comprises stirring paths parallel to each other and stirring screws respectively provided in the stirring paths. A developer is stirred and conveyed by the rotation of the stirring screws From one of the stirring paths to the other through communicating ports disposed at tile lengthwise ends and the center of the stirring paths. One of the stirring screws has delivering means for scooping the developer and delivering it to the other stirring path by the rotation thereof. The other of the stirring screws has distributing means for receiving the developer from the delivering means and distributing it to the right and left portions of the stirring path by the rotation thereof. Both the delivering means and distributing means face the communicating port at the center.

Therefore, the developer collected around the communicating port in one of the stirring path is scooped and fed to the other stirring path by the delivering means, and the fed developer is approximately uniformly delivered to the right and left portions of the stirring path. Thus, the stagnation of the developer around the communicating port is avoided, resulting in making the toner concentration uniform throughout the stirring path.

Moreover, in one embodiment, the delivering means is an angular plate formed around the stirring screw so as to have the pointed portion thereof in the downstream of the rotation direction, and the distributing means is an inclined plate formed around the stirring screw so as to be inclined against the axis of the stirring screw. This simplifies the structure of the developer stirring device.

In another embodiment, one of the stirring screws has spiral stirring plates disposed on the right and left sides of the delivering means so as to spirally move toner toward the delivering means, and the other of the stirring screws has spiral stirring plates disposed on the right and left sides of the distributing means so as to spirally move the toner away from the distributing means. As a result, the developer can be steadily circulated by the delivering means and the distributing means.

In still another embodiment, the stirring screw along the developing roller has a different screw pitch from the stirring screw along the toner supplier. In this case, these stirring screws are different from each other in at least the outer diameter, the rotation speed or the number of threads. Therefore, in the stirring path along the toner supplier, supplied toner is well mixed by sufficient stirring, and in the stirring path along the developing roller, the developer can be rapidly conveyed throughout the developing roller. In this embodiment, the difference in the conveyance performance between the stirring paths caused by the difference in the screw pitches is absorbed by setting the outer diameters, the rotation speed or the numbers of the threads of the stirring screws in accordance with the screw pitches.

In still another embodiment, a pair of toner suppliers are provided in the stirring path along the toner supplier so as to oppose the right and left side of the center communicating port. In this embodiment, a pair of toner concentration sensors for detecting the toner concentration in the developer are provided on the right and left sides of the center communicating port in the stirring path along the developing roller. Thus, the amounts of the toner supplied through the toner suppliers are adjusted based on the detected results obtained by the corresponding toner concentration sensors. Therefore, by adjusting the supplying amount of the toner, the toner concentration can be made further uniform throughout the developing roller.

Moreover, the developing device of this invention comprises the developer stirring device including the delivering means and the distributing means on the stirring screws, a developing roller and a toner supplier. In the developing device, a developer is attracted to the developing roller during the conveyance through one of the stirring paths.

Moreover, the image forming apparatus of this invention comprises the developer stirring device including the delivering means and the distributing means on the stirring screws, a developing roller, a toner supplier, and a photosensitive drum. In the image forming apparatus, a developer is attracted to the developing roller during the conveyance through one of the stirring paths and transferred onto the surface of the photosensitive drum for visualizing an electrostatic latent image.

Therefore, a developer having a uniform toner concentration is attracted at any point throughout the developing roller, thereby attaining an improved development quality.

The above and further objects and features of the invention will more fully be apparent from the following detailed description with accompanying drawings.

DESCRIPTION OF THE PREFERRED EMBODIMENTS

Embodiment 1

Figure 2:
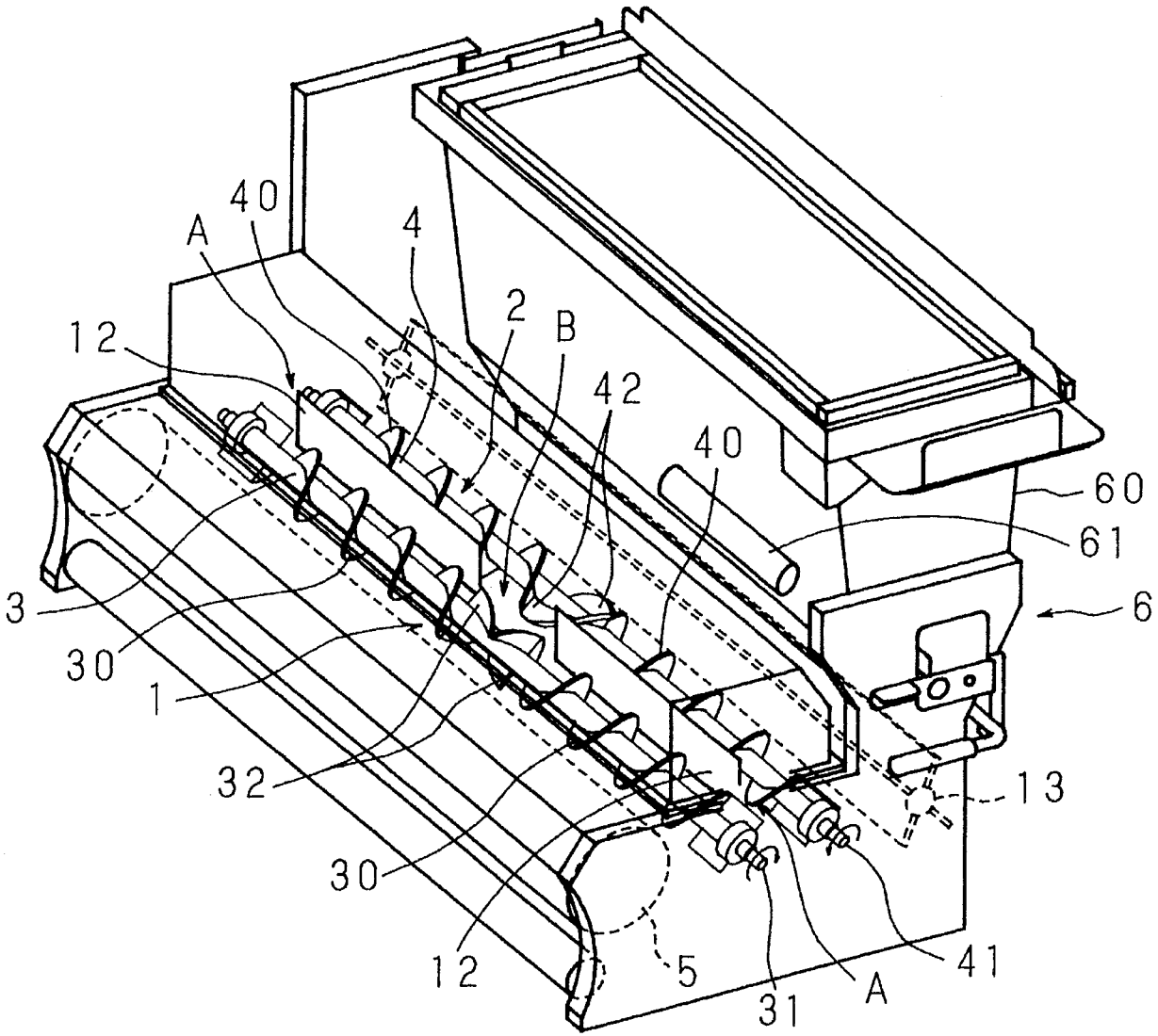
FIG. 2 is a perspective view of a developing device comprising a developer stirring device of embodiment 1 of the present invention.
Figure 3:
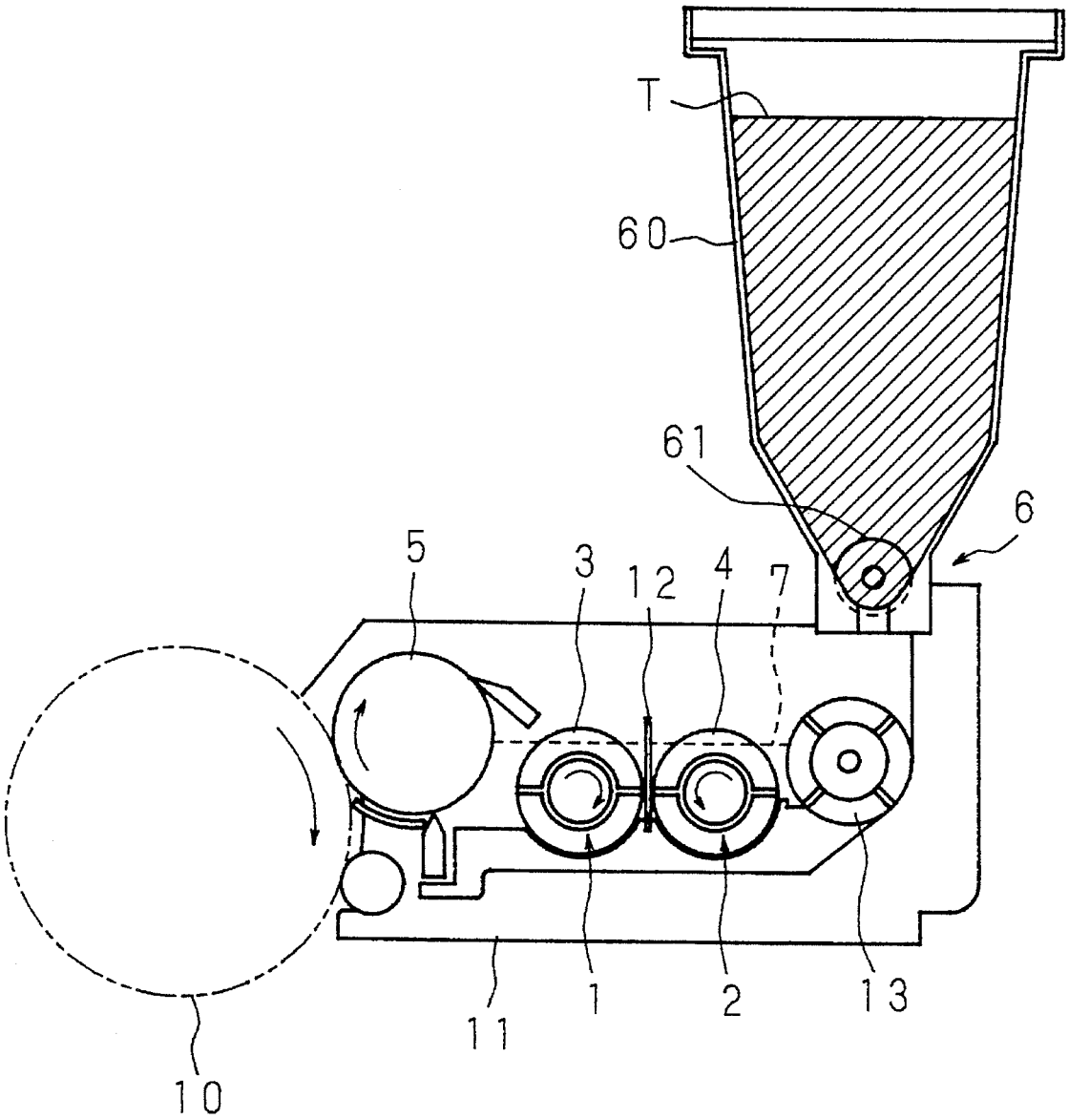
FIG. 3 is a sectional side view of the developing device comprising the developer stirring device of embodiment.

The present invention will now be described referring to the accompanying drawings. FIGS. 2 and 3 are respectively a perspective view and a sectional side view of a developing device comprising a developer stirring device of this invention. The developing device is accommodated in a housing 11 provided on one side of a photosensitive drum 10 shown with alternate long and two short dashes line in FIG. 3, which is one of the elements of an image forming apparatus. The developing device comprises a developing roller 5 opposing the photosensitive drum 10 in proximity and a toner supplier 6 on the opposite side of the developing roller 5 remote from the photosensitive drum 10. The developer stirring device of this invention is provided between the developing roller 5 and the toner supplier 6.

The developing roller 5 is a known magnetic roller comprising a non-magnetic outer cylinder and a plurality of fixed magnets circumferentially disposed on the inner surface of the outer cylinder. The outer cylinder of the developing roller 5 is driven to rotate around an axis parallel to the photosensitive drum 10 in the opposite direction to the rotation direction of the photosensitive drum 10 by driving means (not shown).

The toner supplier 6 comprises a toner hopper 60 disposed above the housing 11 and a toner supplying roller 61 facing a lower opening of the toner hopper 60. The toner supplying roller 61 is a sponge roller driven to rotate around a horizontal axis. Toner T stored in the toner lopper 60 adheres to the outer surface of the toner supplying roller 61 and introduced through the lower opening in accordance with the rotation of the toner supplying roller 61. Thus, the amount of the toner T supplied by the toner supplier 6 can be freely adjusted by changing the number of the rotation of the toner supplying roller 61.

The developer stirring device of this invention comprises stirring paths 1 and 2 disposed between the aforementioned developing roller 5 and the toner supplier 6, and stirring screws 3 and 4 respectively provided in the stirring paths 1 and 2. The housing 11 is divided into two parts by a partition 12 between the stirring paths 1 and 2 the stirring paths 1 and 2 extend along approximately entire length of the developing roller 5 and the toner supplier 6, respectively, and communicate with each other through communicating ports A and B formed by notching the end portions and the center portion of the partition 12.

The stirring screws 3 and 4 in the stirring paths 1 and 2 comprise spiral stirring plates 30, 30 and 40, 40 around axes 31 and 41, respectively, and both the stirring screws 3 and 4 are supported in the housing 11 so as to be approximately parallel to the developing roller 5. The stirring screws 3 and 4 are driven to rotate around the axes 31 and 41 by driving means (not shown). The stirring paths 1 and 2 contain a developer 7 made of a mixture of the toner T supplied by the toner supplier 6 and a carrier to a desired depth not exceeding the height of the partition 12 as shown with a broken line in FIG. 3. The developer 7 is stirred and axially conveyed by the rotation of the stirring screws 3 and 4.

A pre-stirring roller 13 is provided below the toner supplier 6 beside the stirring screw 4. The toner T supplied by the toner supplier 6 is first introduced into the developer 7 by the rotation of the pre-stirring roller 13, further stirred and conveyed by the rotation of the stirring screws 3 and 4, and circulated through the stirring paths 1 and 2 as described below.

Figure 4:
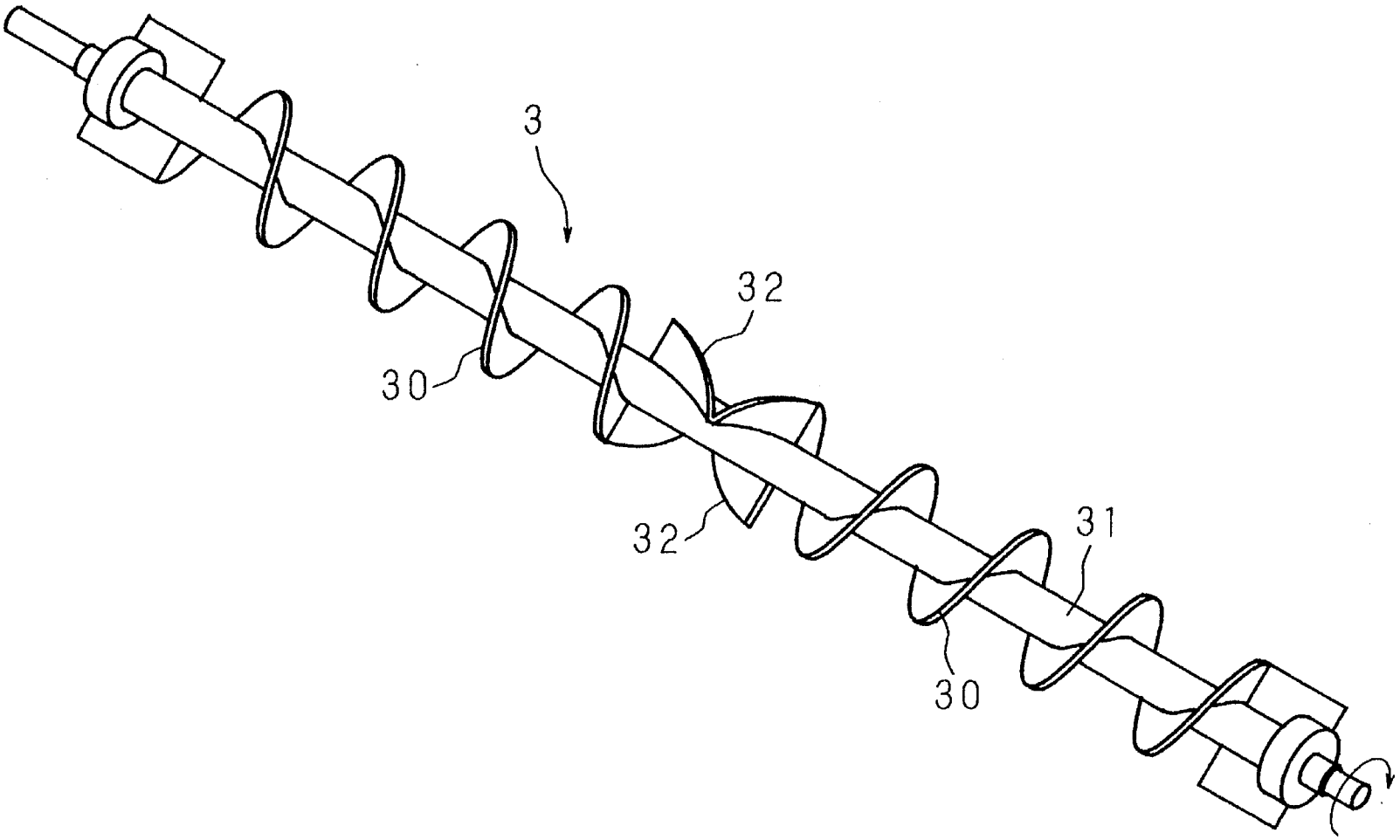
FIG. 4 is a perspective view of one stirring screw of embodiment 1.
Figure 5:
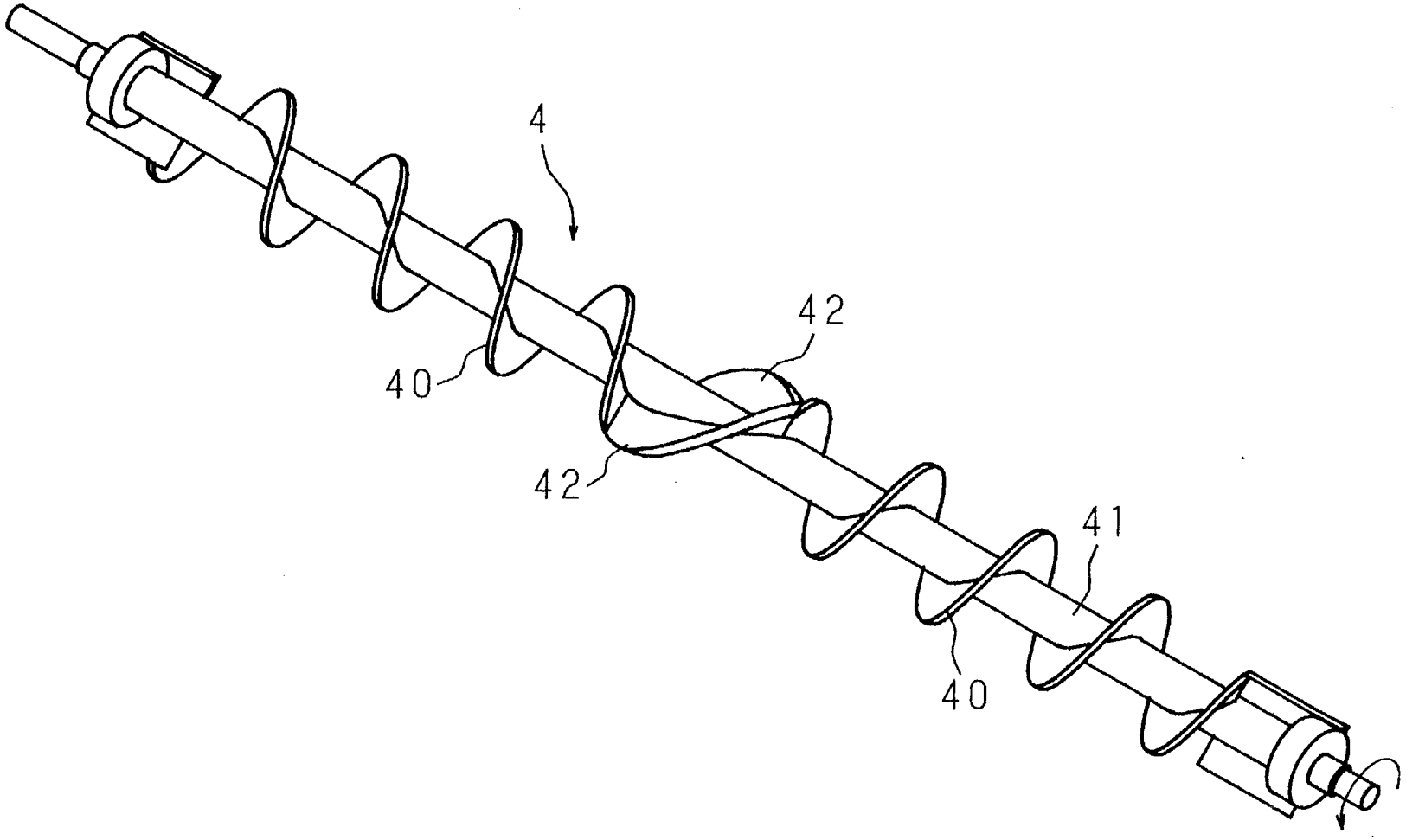
FIG. 5 is a perspective view of the other stirring screw of embodiment 1.

FIGS. 4 and 5 are perspective views of the stirring screws 3 and 4, respectively. As shown in FIG. 4, the stirring plate 30 formed on the right portion of the stirring screw 3 is spirally wound around the axis 31 in the opposite direction from that formed on the left portion. In the middle of the stirring screw 3, the stirring plates 30, 30 of the right and left portions are respectively extended so as to form angular portions pointed circumferentially in the same direction, which work as a pair of delivering means 32, 32. When the stirring screw 3 is mounted as is shown in FIG. 2, the delivering means 32, 32 are located so as to face the communicating port B in the middle of the stirring paths 1 and 2.

The stirring screw 3 rotates, as shown with arrows in FIGS. 2, 3 and 4, so as to head the upper portion thereof toward the other stirring path 2. This rotation direction is set such that the stirring plates 30, 30 on the right and left portions spirally move the developer 7 toward the center of the stirring screw 3, resulting in conveying the developer 7 in the stirring path from the ends toward the center thereof. Further, this rotation direction makes the delivering means 32, 32 in the middle of the stirring screw 3 rotate with the base wider portions ahead and the top pointed portions behind. Therefore, the delivering means 32, 32 scoop the developer 7 conveyed from the right and left portions by the rotation of the stirring plates 30, 30 with their angular portions and deliver the scooped developer 7 through the communicating port B into the stirring path 2.

Also, as shown in FIG. 5, the stirring plate 40 formed on the right portion of the stirring screw 4 is wound around the axis 41 in the opposite direction from that formed on the left portion. In the middle of the stirring screw 4, the stirring plates 40, 40 are extended and inclined at a desired angle against the axis 41 to meet each other, thereby forming inclined plates winding around the axis 41, which work as a pair of distributing means 42, 42. When the stirring screw 4 is mounted as is shown in FIG. 2, the distributing means 42, 42 are located so as to face the communicating port B.

The stirring screw 4 rotates, as shown with arrows in FIGS. 2, 3 and 5, so as to head the upper portion thereof toward the other stirring path 1, i.e., in the opposite direction to the rotation direction of the stirring screw 3. This rotation direction makes the stirring plates 40, 40 spirally move the developer 7 from the center toward the ends so as to convey the developer 7 in the stirring path 2 from the center toward the ends thereof. The inclined planes of the distributing means 42, 42 are positioned face-to-face with the communicating port B twice in one rotation. Mainly when the inclined planes face the communicating port B, the distributing means 42, 42 receive the developer 7 fed through the communicating port B. Then, the stirring screw 4 is further rotated and the received developer 7 is uniformly distributed to the stirring plates 40, 40 to the right and left.

Figure 6A:
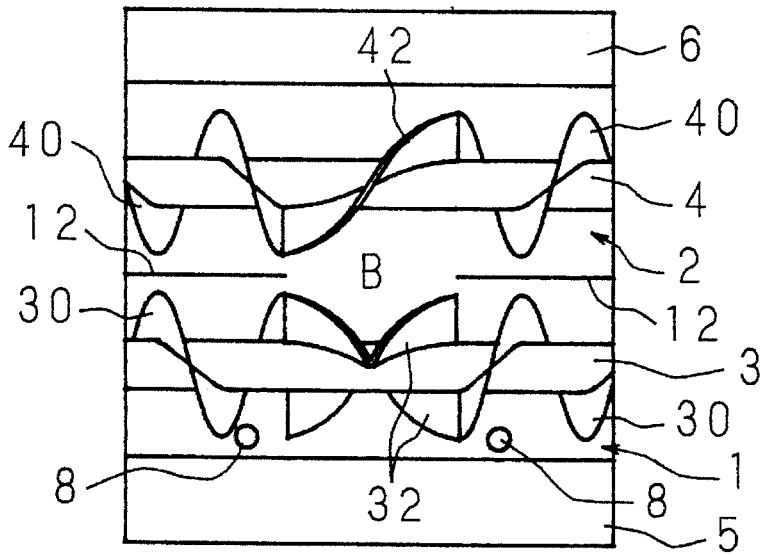
FIGS. 6A through 6C show the operation of the developer stirring device of embodiment 1.
Figure 6B:
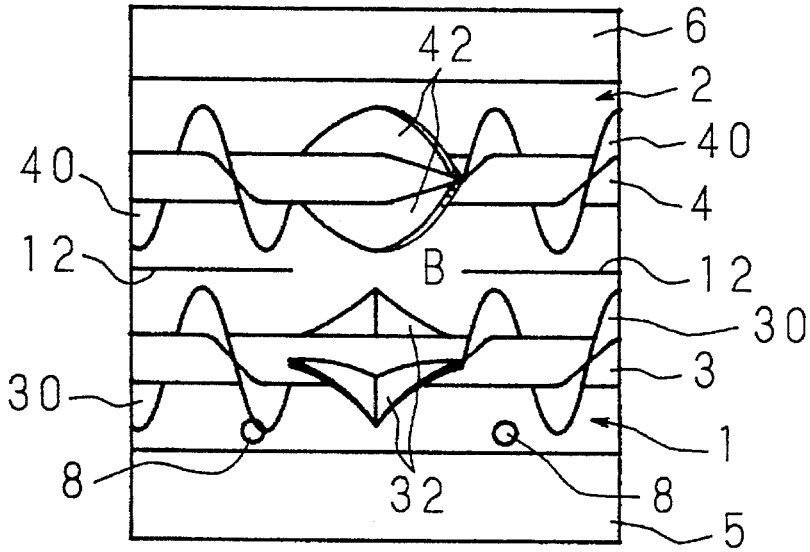
Figure 6C:
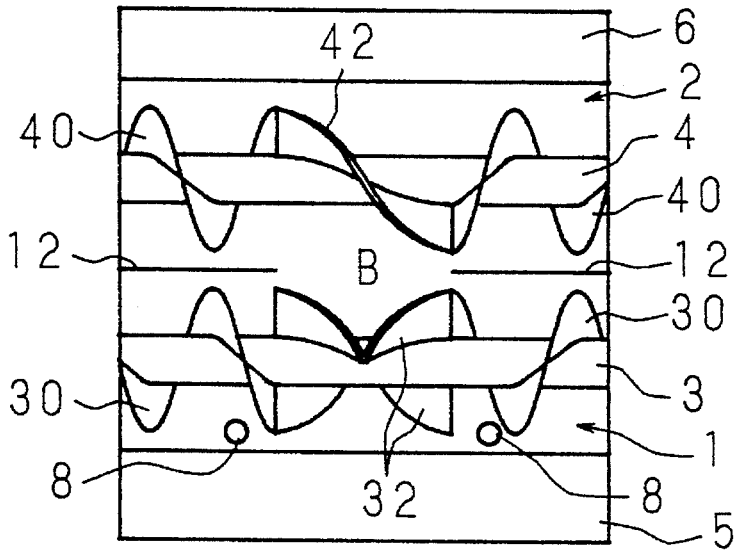

FIGS. 6A through 6C are enlarged plan views around the communicating port. B at the time of the interchange of the developer 7, and show the operation of the developer stirring device of this invention. As shown in FIG. 6A, the stirring screws 3 and 4 rotate in a manner that the distributing means 42, 42 are positioned face-to-face with the communicating port B when one of the pointed portions of the delivering means 32, 32 is positioned upward. FIGS. 6B and 6C show the states of the stirring screws 3 and 4 rotated by 90 degrees and 180 degrees, respectively from that shown in FIG. 6A.

While the stirring screws 3 and 4 are in the state between FIG. 6A and FIG. 6C, the developer 7 scooped with the angular portion of the delivering means 32 is pushed toward the communicating port B, and the pushed developer 7 is fed to the stirring path 2 mainly when the stirring screws 3 and 4 are in the state shown in FIG. 6B. On the other hand, the distributing means 42, 42 of the stirring screw 4 face the communicating port B in the states shown in FIGS. 6A and 6C, and they are in the state shown in FIG. 6B when the developer 7 is fed to the stirring path 2. Therefore, the developer 7 sent from the stirring path 1 to the stirring path 2 is approximately uniformly distributed to the upper and lower portions of the distributing means 42. When the stirring screw 4 is further rotated, the developer 7 having distributed to the upper portion is pushed toward the left-portion of the stirring screw 4, and that having distributed to the lower portion is pushed toward the right portion of the stirring screw 4. Then, the developer 7 is stirred and conveyed by the respective stirring plates 40 toward the ends of the stirring path 2.

The developer 7 is fed to the stirring path 2 also while the stirring screws 3 and 4 are rotated from the state of FIG. 6C to that of FIG. 6A. In this case, the distributing means 42, 42 of the stirring screw 4 are inclined in the opposite direction to that shown in FIG. 6B, i.e., with the left portion upward. Therefore, the developer 7 is distributed in the reverse manner of the aforementioned case. Specifically, the developer 7 in the lower portion of the distributing means 42 is pushed toward the left portion of the stirring screw 4 and that in the upper portion is pushed toward the right portion, and then, the developer 7 is stirred and conveyed by the respective stirring plates 40 toward the ends of the stirring path 2.

As is described above, the delivering means 32, 32 of the stirring screw 3 deliver the developer 7 once in one rotation of the stirring screw 3. As a result, the developer 7 collected in the middle of the stirring path 1 is steadily sent through the communicating port B to the stirring path 2. The developer 7 having been sent to the stirring path 2 is distributed approximately uniformly to the right and left portions of the stirring path 2 owing to the operation of the distributing means 42, 42 facing the communicating port B. Therefore, the developer 7 is circulated through the stirring paths 1 and 2 without stagnating around the communicating port B and is approximately uniformly distributed.

As is shown in FIG. 2, the toner supplier 6 along the stirring path 2, particularly the toner supplying roller 61 serving as a supplying part of the toner T, is provided in a predetermined region extending from the communicating port B as the center. The toner T supplied from the toner hopper 60 by the rotation of the toner supplying roller 61 is introduced into the developer 7 by the rotation of the prestirring roller 13 and added to the developer 7 having been fed to the stirring path 2 through the communicating port B. The supplied toner T is conveyed toward the ends of the stirring path 2, during which it is mixed with the developer 7 by the stirring plates 40, 40 of the stirring screw 4. During this conveyance, the toner T is uniformly distributed in the developer 7, and fed to the stirring path 1 through the communicating ports A formed by notching the partition 12 at both the ends.

The developer 7 fed to the stirring path 1 is further stirred and conveyed toward the center by the stirring plates 30, 30 of the stirring screw 3. During this conveyance, the developer is attracted by the developing roller 5 disposed along the stirring path 1, and used for the development of an electrostatic latent image formed on the photosensitive drum 10 as described above. After the contact with the developing roller 5, the remained developer 7 is collected around the center of the stirring screw 3, sent to the stirring path 2 through the communicating port B, conveyed toward the ends of the stirring path 2 by the rotation of the stirring screw 4, and then fed to the stirring path 1 through the communicating ports A again. This cycle is repeated thereafter.

The toner T in the developer 7 is used for the aforementioned development, and therefore, the toner concentration in the developer 7 is reduced as is conveyed through the stirring path 1. The developer 7, however, is conveyed not throughout the stirring path 1 but between one of the end communicating ports A and the center communicating port B, that is, approximately half the length of the stirring path 1. Every time the developer 7 is sent back to the stirring path 2 after the conveyance through the half of the stirring path 1, fresh toner T is supplied. Then, the developer 7 attains a desired toner concentration during the conveyance toward the ends of the stirring path 2 by the stirring function of the stirring screw 4. In this manner, the developer 7 having a desired toner concentration is fed to the stirring path 1 again. Therefore, the toner concentration of the developer 7 to be attracted by the developing roller 5 for the development can be uniformly increased at any point throughout the developing roller 5.

In the developer stirring device of this invention, the stirring screw 3 in the stirring path 1 comprises the delivering means 32, 32 facing the communicating port B. Owing to these delivering means 32, the developer 7 collected in the middle of the stirring path 1 is fed to the stirring path 2 without causing stagnation around the communicating port B. As a result, it is possible to prevent the reduction in the toner concentration around the center of the developing roller 5 caused by the stagnation.

Furthermore, the stirring screw 4 in the stirring path 2 comprises the distributing means 42, 42 facing the communicating port B. Owing to these distributing means 42, the developer 7 fed through the communicating port B is approximately uniformly distributed to the right and left portions of the stirring path 2. As a result, the developer 7 circulating through the right and left portions of the stirring paths 1 and 2 can be interchanged, thereby making uniform the toner concentration in the right and left portions of the developing roller 5. Therefore, the developer 7 attracted by the developing roller 5 for the development steadily has a desired uniform toner concentration at any point throughout the developing roller 5, resulting in improving the development quality.

The toner concentration in the developer 7 is detected by toner concentration sensors 8, 8 (shown in FIGS. 6A through 6C). The toner concentration sensors 8, 8 are provided on the right and left sides of the communicating port B in the stirring path 1 along the developing roller 5, i.e., at positions where the toner concentration becomes the lowest. The detected result of the toner concentration is used for controlling the supplying amount of the toner T by the toner supplier 6. Specifically, the supplying amount of the toner T is controlled by increasing or reducing the number of the rotation of the toner supplying roller 61 in one supplying operation based on the toner concentration detected by the toner concentration sensors 8, 8.

Embodiment 2

Figure 7:
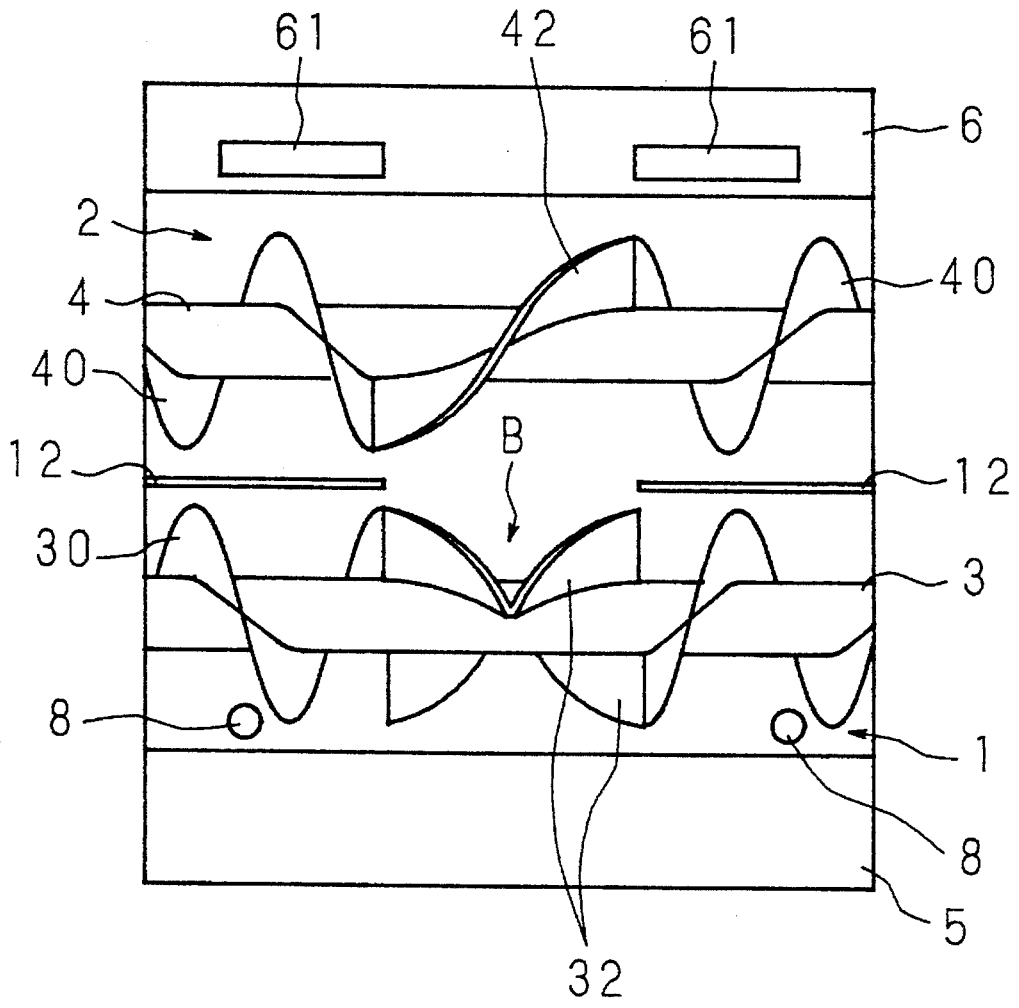
FIG. 7 is an enlarged plan view of a major part of a developer stirring device of embodiment 2.

FIG. 7 is an enlarged plan view of a major part of a developer stirring device of embodiment 2 of this invention. In this embodiment, a pair of toner supplying rollers 61 are provided in the stirring path 2 along the toner supplier 6 so as to oppose the right and left sides of the communicating port B. The toner supplying rollers 61, 61 can be independently driven by respective driving means (not shown). The supplying amounts of the toner supplied by the respective toner supplying rollers 61, 61 are controlled based on the detection results of the corresponding toner concentration sensors 8, 8, thereby respectively adjusting the amounts of the toner T supplied on the right and left sides of the communicating port B. Except for the above, the developer stirring device of this embodiment has the same configuration as that of Embodiment 1, and therefore, the same reference numerals are used to refer to the same elements and the description thereof is herein omitted. The developer stirring device of this embodiment can attain further uniform toner concentration in the right and left portions of the developing roller 5.

Embodiment 3

Figure 8:
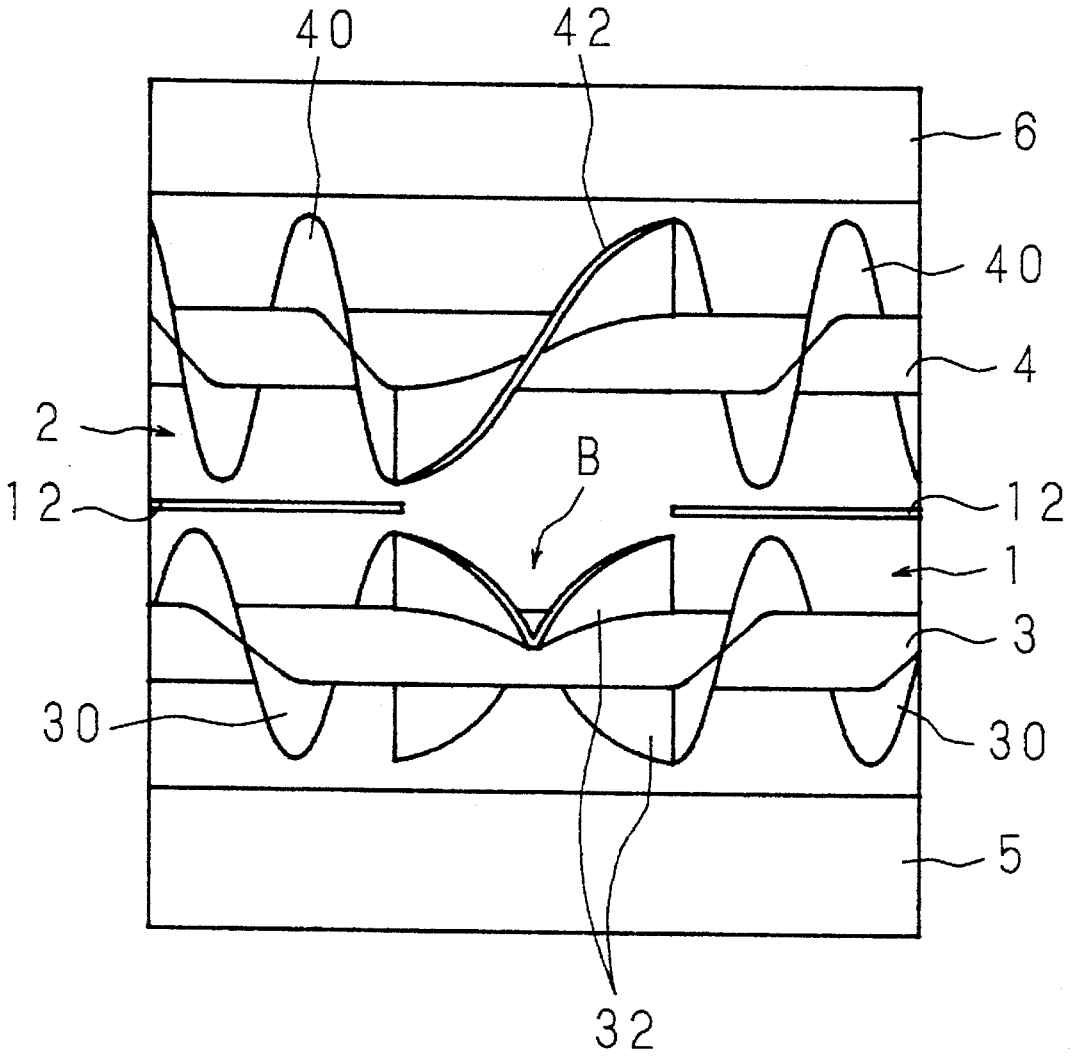
FIG. 8 is an enlarged plan view of a major part of a developer stirring device of embodiment 3.

FIG. 8 is an enlarged plan view of a major part of a developer stirring device of Embodiment 3 of this invention in the developer stirring device of this embodiment, the stirring screws 3 and 4 provided in the stirring paths 1 and 2 have different screw pitches from each other, i.e., the winding pitches of the stirring plates 30 and 40 are different from each other. Specifically, the screw pitch of the slitting screw 4 is smaller than that of the stirring screw 3. Except for the above, the developer stirring device of this embodiment has the same configuration as that of Embodiment 1, and therefore, the same reference numerals are used to refer to the same elements and the description thereof is herein omitted.

The screw pitches are made different from each other for the following reason: As described above, while the developer 7 is circulated, the developer 7 is required to be sufficiently stirred in the stirring path 2 in order to distribute fresh toner T therein. In the stirring path 1, the developer 7 is required to be conveyed quickly along the developing roller 5 in order to prevent the toner concentration from reducing. Therefore, in the developer stirring device of Embodiment 3, the developer 7 is sufficiently stirred by the rotation of the stirring screw 4 with a smaller pitch during the conveyance through the stirring path 2, thereby attaining a uniform distribution of the toner T in the developer 7 when it is fed to the stirring path 1. Further, after the developer 7 is fed to the stirring path 1, it is rapidly conveyed by the rotation of the stirring screw 3 with a larger pitch, and thus it is possible to suppress reduction of the toner concentration, which may be caused by attraction by the developing roller 5. Thus, the development quality can be made uniform throughout the developing roller 5.

Figure 9:
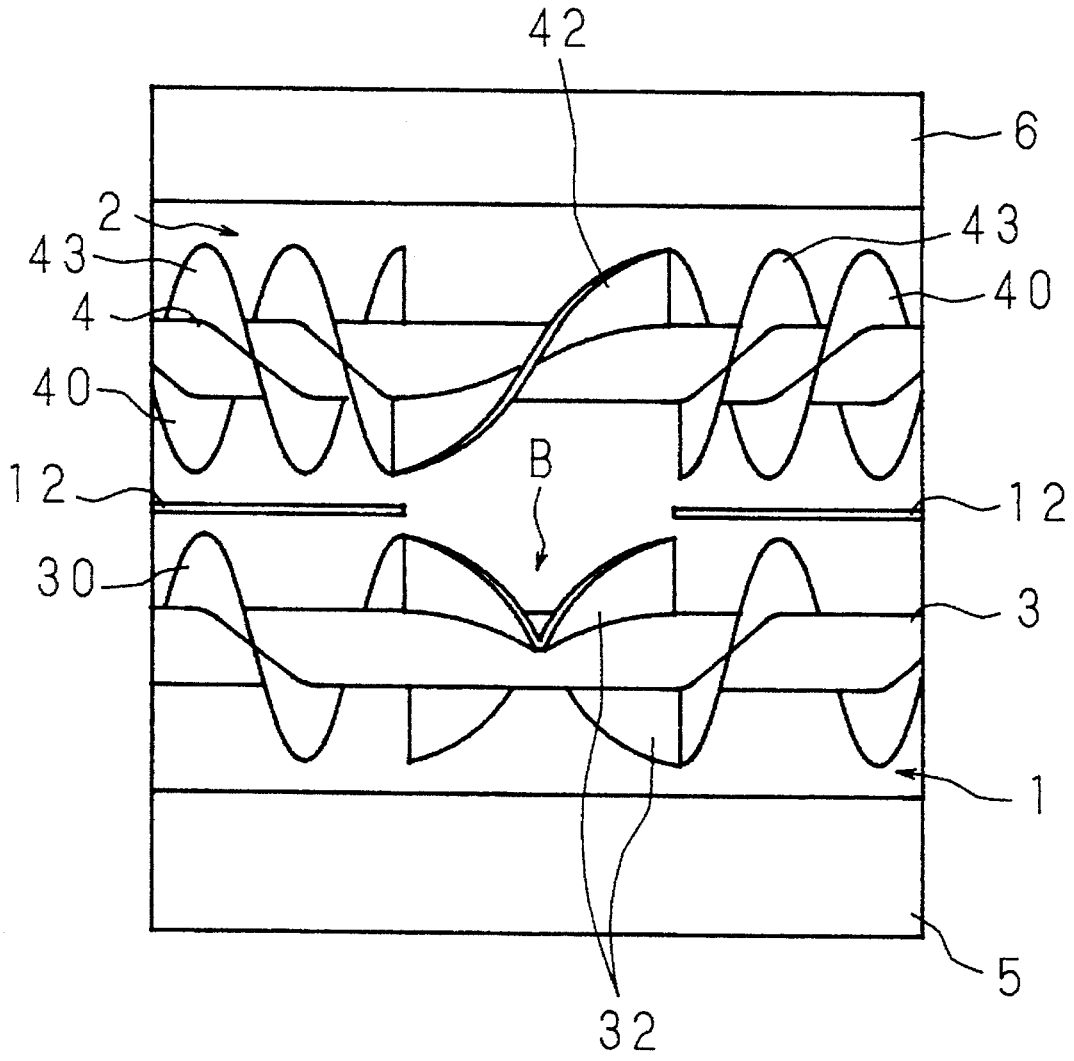
FIG. 9 is an enlarged plan view of a major part of a developer stirring device of still another example of tis invention.

In the developer stirring device of this embodiment, it is necessary to absorb the difference in the conveyance performance between the stirring screws 3 and 4 due to the difference in their screw pitches. In this embodiment, the outer diameter of the stirring screw 4 with the smaller pitch is larger than that of the stirring screw 3 with the larger pitch for this purpose. The method for absorbing the difference, however, is not limited to this, and the following can attain the same effect: the stirring screw 4 is driven at a larger rotation speed than the stirring screw 3; and the stirring screw 4 has a larger number of threads of spiral stirring plates 40 and 43 as shown in a plan view of FIG. 9.

Figure 1:
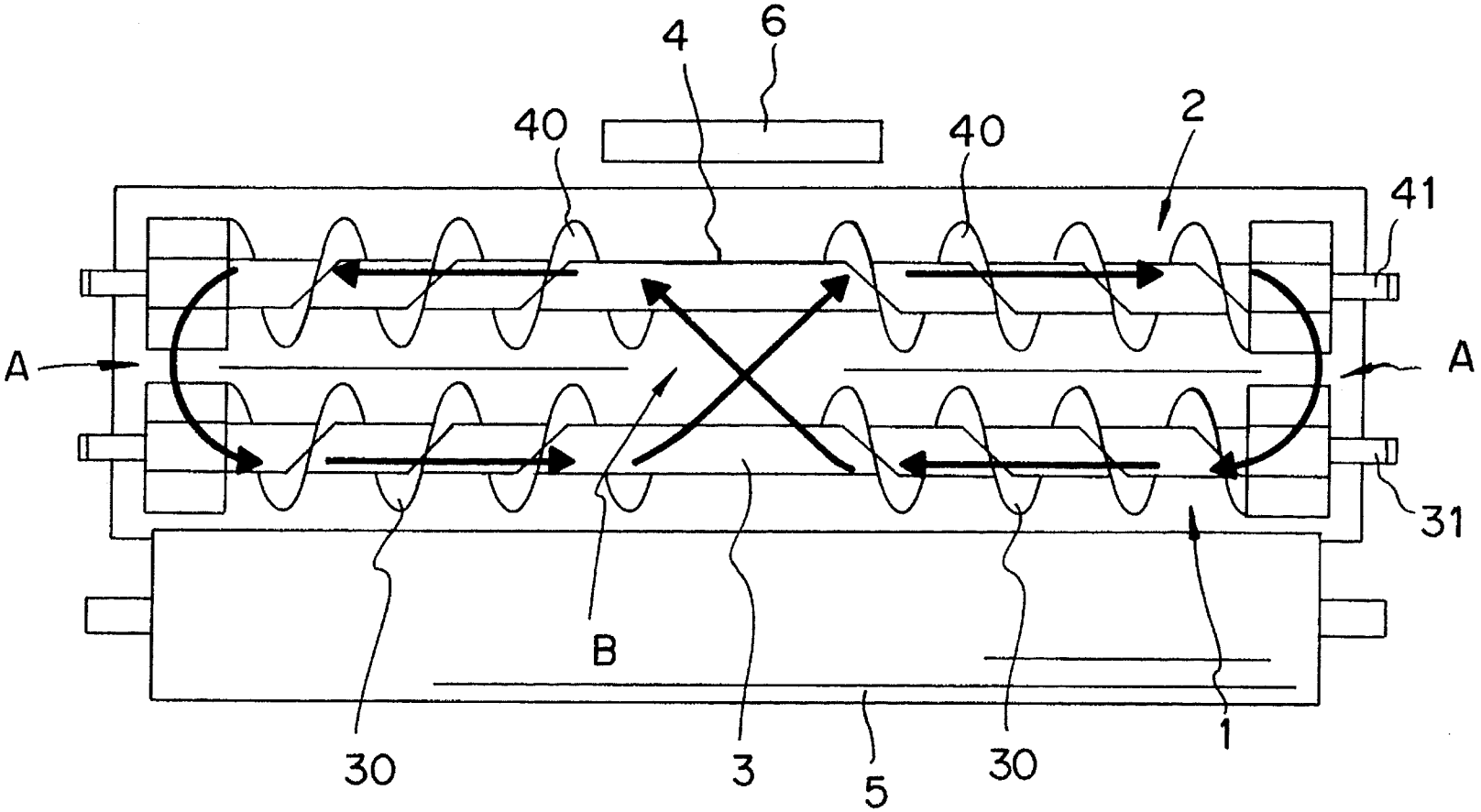
FIG. 1 PRIOR ART
FIG. 1 shows the operation of a conventional developer stirring device.
Figure 10:
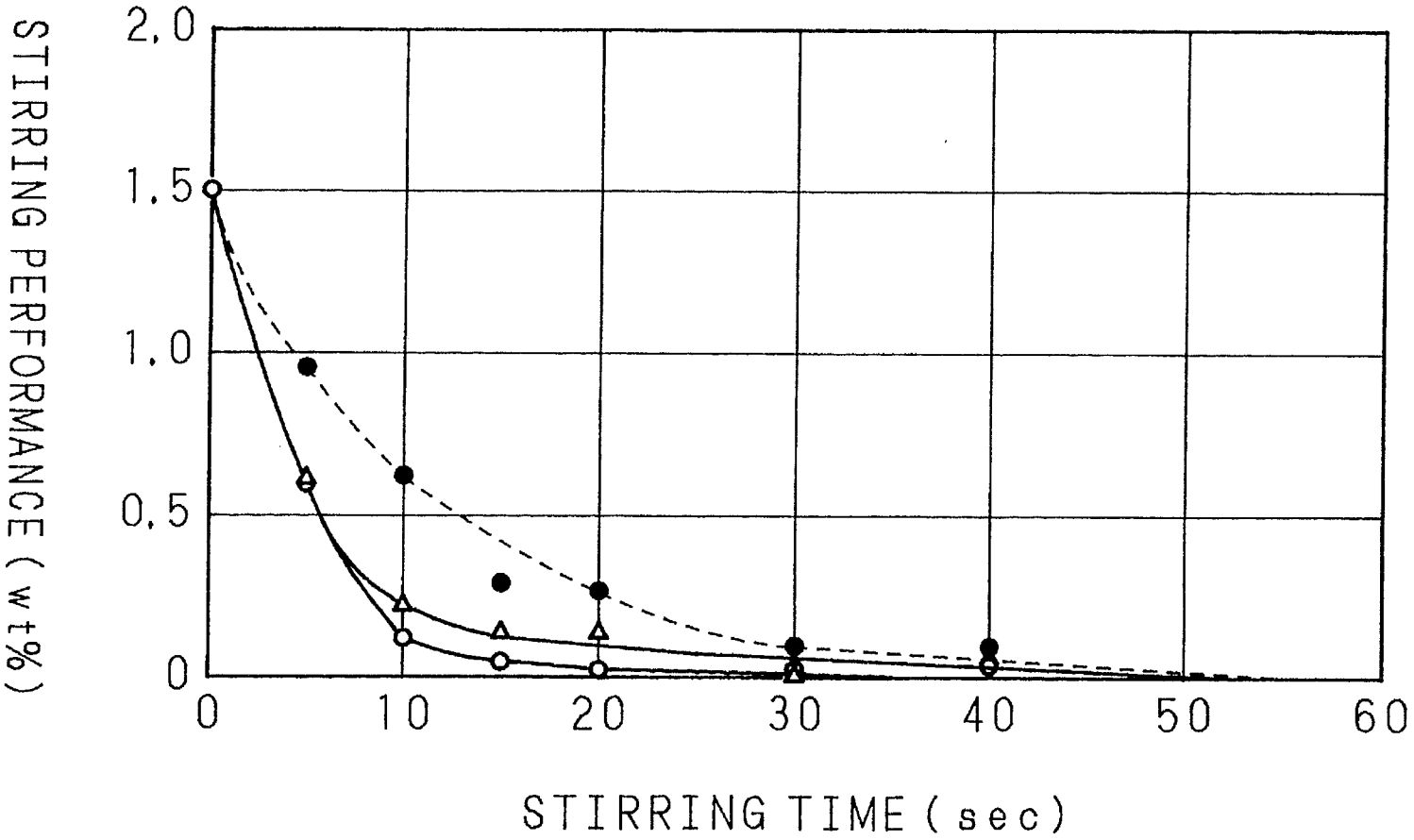
FIG. 10 is a graph showing the comparison in stirring performance between the developer stirring device of this invention and the conventional developer stirring device.

FIG. 10 is a graph showing the results of comparison in the performance of stirring the developer 7 between the developer stirring device of embodiment 1 and the conventional developer stirring device of FIG. 1. The stirring performance was measured as follows: The developer 7 of 2700 g was circulated through the stirring paths 1 and 2, and the toner of 13.5 g was supplied around a desired toner supplying position including the center communicating port B. The toner concentration was successively measured at both ends and around the center of the stirring path 1, thereby checking the change in the measured concentration with time.

The abscissa of the graph indicates the stirring time starting from the supply of the toner T, and the ordinate indicates the stirring performance, which is obtained as a total of a difference between the measured toner concentration at each measuring point and the objective toner concentration 6.0 wt % to be attained in the end. The results shown with ○ and Δ are obtained by the developer stirring device of this invention, and the results shown with ● are obtained by the conventional developer stirring device. The rotation speed of the stirring screws 3 and 4 was 272 rpm in the devices used to obtain the results shown with ○ and ●, and was 180 rpm in the device used to obtain the results Δ.

As is apparent from FIG. 10, in the developer stirring device of this invention, the toner concentration at each measuring point approaches the objective value, i.e., 6.0 wt %, rapidly after the start of the stirring, and becomes approximately 6.0 wt % in 20 to 30 seconds. In the conventional developer stirring device, even 40 seconds after the start, there is still a difference between the measured concentration and the objective value 6.0 wt %. In the developer stirring device of this invention, when the rotation speed of the stirring screws 3 and 4 are increased, the stirring performance is excellent, although a higher rotation speed causes a problem of scattering the stirred developer 7. Therefore, it is necessary to select the rotation speed of the stirring screws 3 and 4 so as not to cause this problem. When the stirring screws 3 and 4 are rotated at a speed of 180 rpm, the developer stirring device of this invention exhibits a much higher stirring performance than the conventional developer stirring device driven at a rotation speed of the stirring screws of 272 rpm. This reveals that the present developer stirring device can attain a stirring performance higher than that of the conventional developer stirring device while reducing the scatter of the developer 7 caused by the rotation of the stirring screws 3 and 4.

In the aforementioned embodiments, the stirring screw 3 in the stirring path 1 along the developing roller 5 is provided with the delivering means 32 and the stirring screw 4 in the stirring path 2 along the toner supplier 6 is provided with the distributing means 42. The distributing means, however, can be provided to the stirring screw 3 and the delivering means can be provided to the stirring screw 4. The structures of the delivering and distributing means are not, limited to those described in the embodiments and may include any structure that can attain the respective functions.

As is described above, the developer stirring device of this invention is provided between the developing roller and the toner supplier. The stirring screws disposed in the stirring paths communicating with each other through both the ends and the center are respectively provided with the delivering means and the distributing means facing the center communicating port. The developer in one of the stirring paths is scooped by the delivering means, fed to the other stirring path, and distributed to the right and left portions of this stirring path. As a result, the developer can be steadily circulated through the stirring paths without stagnating around the center communicating port in this manner, the toner concentration in the developer at any point throughout the developing roller can be as uniform as possible, resulting in a stable high development quality.

Moreover, since the delivering means and the distributing means are formed with the plates winding around the stirring screws, the aforementioned effect can be attained in a simple structure. Further, since the stirring screw having the delivering means is provided with the stirring plates spirally extending toward the delivering means and the stirring screw having the distributing means is provided with the stirring plates spirally extending away from the distributing means, the developer can be steadily circulated as described above.

Furthermore, since the screw pitches of the stirring screws in the stirring paths respectively disposed along the developing roller and the toner supplier are different from each other, the toner concentration in the developer can be rapidly made uniform by sufficient stirring in the stirring path along the toner supplier, and the developer can be rapidly conveyed along the developing roller in the stirring path along the developing roller. Therefore, the toner concentration is prevented from reducing during the conveyance, resulting in providing an improved development quality. Still more, since the screw pitches are made different, and the outer diameters, the rotation speeds or the numbers of threads of the two stirring plates are also made different from each other, the difference in the conveyance performance due to the difference in the screw pitches can be absorbed, thereby avoiding the stagnation of the developer during the conveyance.

Further, a pair of the toner supplying rollers are provided in the stirring path along the toner supplier so as to oppose the right and left sides of the communicating port, and a pair of the toner concentration sensors are provided on the right and left sides of the communicating port in the stirring path along the developing roller. Thus, the amount of the toner supplied by the toner supplier can be adjusted based on the detection result of each corresponding toner concentration sensor. Therefore, the toner concentration throughout the developing roller can be made further uniform, resulting in a further improved development quality.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A developer stirring device comprising:

stirring paths disposed parallel to each other and communicating with each other through communicating ports provided at lengthwise opposite ends and intermediate portions remote from the opposite ends of said respective stirring paths; and stirring screws respectively disposed in said stirring paths for stirring and conveying a developer from one of said stirring paths to the other through said communicating ports by rotation of said stirring screws, wherein one of said stirring screws comprises delivering means for scooping and delivering said developer to the other of said stirring screws by the rotation thereof, said delivering means facing said communicating port at the intermediate portion, and the other of said stirring screws comprises distributing means for receiving said developer from said delivering means and distributing said developer to toward the opposite ends by the rotation thereof, said distributing means facing said communicating port, at the intermediate portion.

2. A developer stirring device according to claim 1, wherein said delivering means is an angular plate wound around one of said stirring screws so as to have a pointed portion in downstream of a rotation direction thereof.

3. A developer stirring device according to claim 1, wherein said distributing means is an inclined plate disposed around one of said stirring screws so as to be inclined against an axis thereof.

4. A developer stirring device according to claim 1, wherein said delivering means is an angular plate wound around one of said stirring screws so as to have a pointed portion in downstream of a rotation direction thereof, and said distributing means is an inclined plate disposed around the other of said stirring screws so as to be inclined against an axis thereof.

5. A developer stirring device according to claim 1, wherein one of said stirring screws includes spiral stirring plates disposed at opposite sides of said delivering means so as to spirally extend toward said delivering means, and the other of said stirring screws includes spiral stirring plates disposed at opposite sides of said distributing means so as to spirally extend away from said distributing means.

6. A developer stirring device according to claim 2, wherein one of said stirring screws includes spiral stirring plates disposed at opposite sides of said delivering means so as to spirally extend toward said delivering means, and the other of said stirring screws includes spiral stirring plates disposed at opposite sides of said distributing means so as to spirally extend away from said distributing means.

7. A developer stirring device according to claim 3, wherein one of said stirring screws includes spiral stirring plates disposed at opposite sides of said delivering means so as to spirally extend toward said delivering means, and the other of said stirring screws includes spiral stirring plates disposed at opposite sides of said distributing means so as to spirally extend away from said distributing means.

8. A developer stirring device according to claim 4, wherein one of said stirring screws includes spiral stirring plates disposed at opposite sides of said delivering means so as to spirally extend toward said delivering means, and the other of said stirring screws includes spiral stirring plates disposed at opposite sides of said distributing means so as to spirally extend away from said distributing means.

9. A developer stirring device according to claim 1, wherein said stirring screws have different screw pitches from each other.

10. A developer stirring device according to claim 2, wherein said stirring screws have different screw pitches from each other.

11. A developer stirring device according to claim 3, wherein said stirring screws have different screw pitches from each other.

12. A developer stirring device according to claim 5, wherein said stirring screws have different screw pitches from each other.

13. A developer stirring device according to claim 9, wherein said stirring screws have different outer diameters from each other.

14. A developer stirring device according to claim 10, wherein said stirring screws have different outer diameters from each other.

15. A developer stirring device according to claim 11, wherein said stirring screws have different outer diameters from each other.

16. A developer stirring device according to claim 12, wherein said stirring screws have different outer diameters from each other.

17. A developer stirring device according to claim 9, wherein said stirring screws are driven at different, rotation speed from each other.

18. A developer stirring device according to claim 10, wherein said stirring screws are driven at different rotation speed from each other.

19. A developer stirring device according to claim 11, wherein said stirring screws are driven at different, rotation speed from each other.

20. A developer stirring device according to claim 12, wherein said stirring screws are driven at different rotation speed from each other.

21. A developer stirring device according to claim 5, wherein said stirring plates of said stirring screws are different in number of threads from each other.

22. A developer stirring device according to claim 6, wherein said stirring plates of said stirring screws are different in number of threads from each other.

23. A developer stirring device according to claim 7, wherein said stirring plates of said stirring screws are different in number of threads from each other.

24. A developer stirring device according to claim 12, wherein said stirring plates of said stirring screws are different in number of threads from each other.

25. A developing device comprising:

stirring paths disposed parallel to each other and communicating with each other through communicating ports at lengthwise opposite ends and intermediate portions remote from the opposite ends of said stirring paths;

a toner supplier for supplying toner to one of said stirring paths;

stirring screws respectively disposed in said stirring paths for stirring and conveying a developer from one of said stirring paths to the other through said communicating ports by rotation of said stirring screws; and a developing roller for receiving said developer during conveyance through the other of said stirring paths, wherein one of said stirring screws comprises delivering means for scooping and delivering said developer to the other said stirring screws by the rotation thereof, said delivering means facing said communicating port, at the intermediate portion, and the other of said stirring screws comprises distributing means for receiving said developer from said delivering means and distributing said developer toward the opposite ends by the rotation thereof, said distributing means facing said communicating port at the intermediate portion.

26. A developing device according to claim 25, wherein said toner supplier is plural in number and supplies the toner toward the opposite sides of said communicating port at the intermediate portion in one of said stirring paths.

27. A developing device according to claim 26 further comprising toner concentration sensors for detecting a toner concentration in said developer at opposite sides of said communicating port at the intermediate portion in one of said stirring paths, wherein said toner suppliers adjust the amount of the toner to be supplied based on the toner concentration detected by said toner concentration sensors.

28. An image forming apparatus comprising:

stirring paths disposed parallel to each other and communicating with each other through communicating ports at lengthwise opposite ends and intermediate portions remote from the opposite ends of said stirring paths;

a toner supplier fox supplying toner to one of said stirring paths;

stirring screws respectively disposed in said stirring paths for stirring and conveying a developer from one of said stirring paths to the other through said communicating ports by rotation of said stirring screws;

a developing roller for receiving said developer during conveyance through the other of said stirring paths; and a photosensitive drum disposed so as to oppose said developing roller for visualizing an electrostatic latent image formed thereon by transferring said developer onto a surface thereof, wherein one of said stirring screws comprises delivering means for scooping and delivering said developer to the other of said stirring screws by the rotation thereof, said delivering means facing said communicating port at the intermediate portion, and the other of said stirring screws comprises distributing means for receiving said developer from said delivering means and distributing said developer toward the opposite ends by the rotation thereof, said distributing means facing said communicating pool at the intermediate portion.

* * * * *